United States Patent [19]

Moertel

[11] 4,353,760

[45] Oct. 12, 1982

[54] FORMING ARTICLES WITH SLIDE FASTENERS AND ATTACHED SEWING GUIDES

[75] Inventor: George B. Moertel, Conneautville, Pa.

[73] Assignee: American Thread, Stamford, Conn.

[21] Appl. No.: 214,407

[22] Filed: Dec. 8, 1980

[51] Int. Cl.[3] ..... A44B 19/42; A44B 19/34

[52] U.S. Cl. ..... 156/66; 2/265; 24/205.1 R; 24/205.16 D; 24/205.16 R; 112/265.2; 156/227; 156/252; 156/291; 223/44

[58] Field of Search ..... 2/265, 266; 24/205.1 R, 24/205.16 D, 205.16 R; 29/408; 112/265.2; 156/66, 252, 291, 227; 223/44

[56] References Cited

U.S. PATENT DOCUMENTS

| | | | |
|---|---|---|---|
| 3,286,669 | 11/1966 | Rockerath et al. | 112/265.2 |
| 3,348,509 | 10/1967 | Degraw | 112/265.2 |
| 3,456,305 | 7/1969 | Voit | 24/205.11 R |
| 3,648,293 | 3/1972 | Del Vecchio | 24/205.1 R X |
| 3,793,683 | 2/1974 | Thaeler | 156/66 X |
| 3,883,931 | 5/1975 | Peterson | 24/205.11 R |
| 4,001,072 | 1/1977 | deNeui | 156/461 |
| 4,265,190 | 5/1981 | Moertel | 112/265.2 |

*Primary Examiner*—Edward C. Kimlin
*Assistant Examiner*—Robert A. Dawson
*Attorney, Agent, or Firm*—Anthony A. O'Brien

[57] ABSTRACT

A method for forming slide fasteners with attached sewing guides is disclosed wherein a stock strip of paper is coated with adhesive and release material and subsequently formed into pairs of member sections which are folded and then assembled on center sections to form composite sections. Perforated sewing lines and/or window openings are punched in the composite sections and the composite sections are attached by at least two of the strips of the pressure sensitive adhesive to the tapes of slide fasteners to form slide fasteners with attached sewing guides.

14 Claims, 6 Drawing Figures

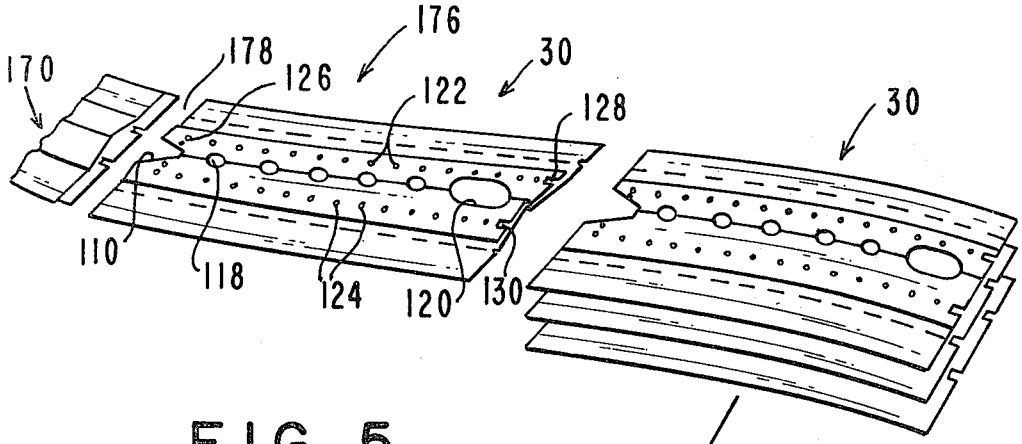
FIG. 5
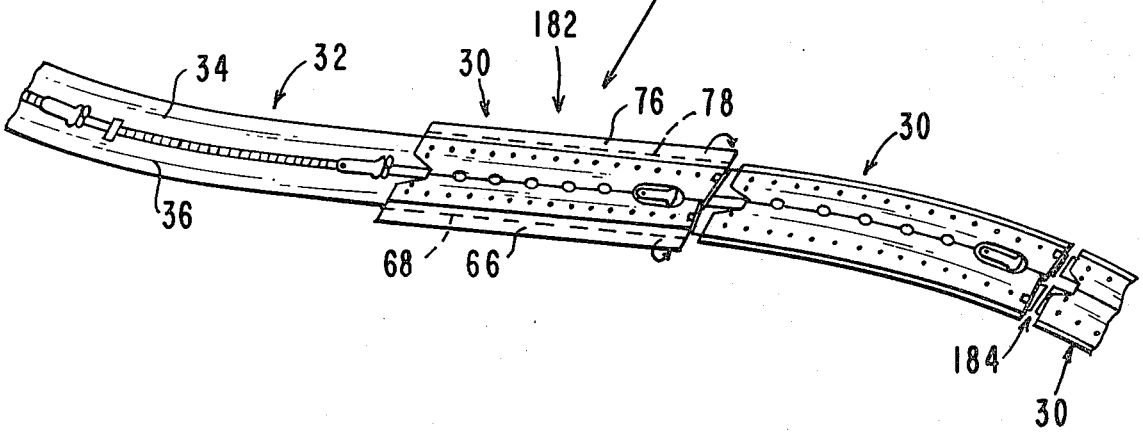
FIG. 6
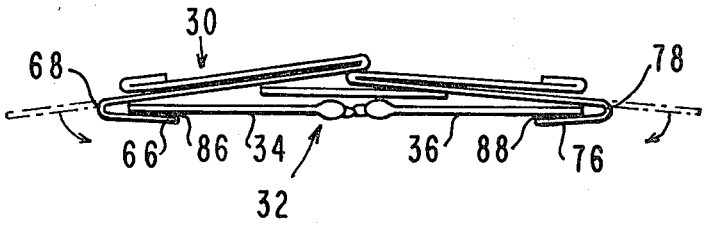

FORMING ARTICLES WITH SLIDE FASTENERS AND ATTACHED SEWING GUIDES

TECHNICAL FIELD

The present invention relates to the manufacture of slide fasteners with sewing aids.

DESCRIPTION OF THE PRIOR ART

The prior art, as exemplified in U.S. Pat. Nos. 3,286,669, 3,348,509 and 3,456,305, contains a number of aids for sewing slide fasteners in an article or garment. In addition, the prior art, as exemplified in U.S. Pat. Nos. 3,883,931 and 4,001,072, contains various methods of assemblying diverse articles. The above U.S. Pat. No. 3,883,931 discloses a technique of sealing slide fastener tapes to sheets of thermoplastic. The above U.S. Pat. No. 4,001,072 discloses a technique for applying a short length of pressure-sensitive adhesive tape to an article.

SUMMARY OF THE INVENTION

The invention is summarized in a method of forming slide fasteners with attached sewing guides including coating a stock strip of paper with strips of adhesive and release material, the adhesive strips being suitable for adhering to tapes of a slide fastener and to an article to which the slide fastener is to be sewn, forming pairs of member sections with folded article-holding flaps from the stock strip, attaching the pairs of member sections to center strip sections to form composite strip sections, punching perforations in the composite sections, and attaching the composite strip by means of at least two of the strips of adhesive to the tapes of a slide fastener.

An object of the present invention is to provide a method of forming articles including sewing guides attached to slide fasteners wherein the method is efficient, inexpensive and suitable for mass production.

Another object of the invention is to utilize relatively inexpensive paper stock material and inexpensive adhesive and release coating material in forming slide fasteners with attached sewing guides.

Other objects, advantages and features of the invention will be apparent from the following description of the preferred embodiment taken in conjunction with the accompanying drawings.

BRIEF DESCRIPTION OF THE DRAWINGS

FIG. 5 is a diagram illustrating several steps subsequent to the steps of FIGS. 3 and 4.

FIG. 6 is a cross-section view of a slide fastener chain and sewing guide during one step of FIG. 5.

DESCRIPTION OF THE PREFERRED EMBODIMENT

Figure 1:
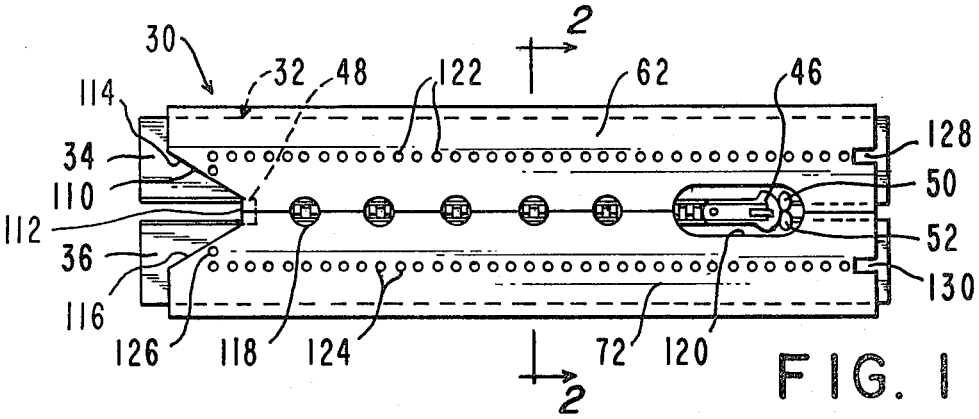
FIG. 1 is a plan view of an article including a slide fastener with attached sewing guide manufactured in accordance with the invention.
Figure 2:
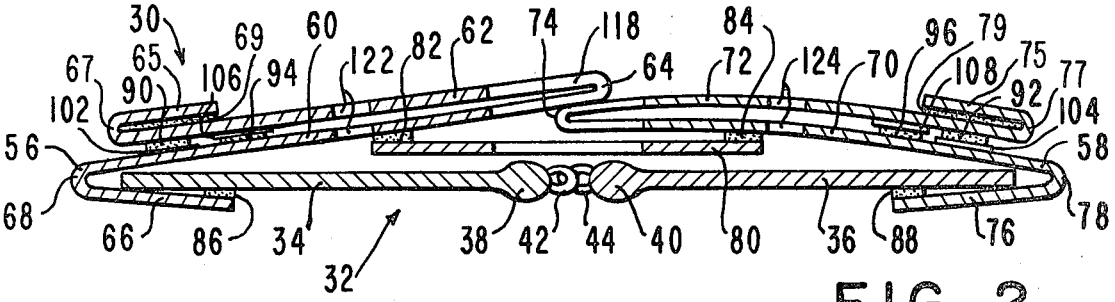
FIG. 2 is an enlarged cross-section view taken at line 2—2 in FIG. 1.

As shown in FIGS. 1 and 2, an article manufactured in accordance with the method of the invention includes a guide indicated generally at 30 carrying or attached to a slide fastener indicated generally at 32. The preferred method of manufacturing the article of FIGS. 1 and 2 is illustrated in FIGS. 3, 4, 5 and 6. An understanding of the use or employment of the article of FIGS. 1 and 2 in the installation of the slide fastener 32 in a garment, or other article, can be had by referring to applicant's copending U.S. application, Ser. No. 911,570, filed June 1, 1978 for "SEWING AID FOR SLIDE FASTENER AND METHOD" (now U.S. Pat. No. 4,265,190), which is incorporated herein by reference.

The slide fastener 32 is a conventional slide fastener including a pair of carrier tapes such as textile carrier tapes 34 and 36 having inner beaded edges 38 and 40 carrying respective coupling elements 42 and 44. A slider 46 is slidably mounted on the beaded edges 38 and 40 and coupling elements 42 and 44 for opening and closing the slide fastener. A bottom stop 48 is attached to the slide fastener 30 across the coupling elements 42 and 44 at the bottom end of the slide fastener for limiting downward movement of the slider 46 as well as securing the bottoms of the tapes 34 and 36 together. Top stops 50 and 52 are mounted at the upper ends of the respective coupling elements 42 and 44 for limiting upward movement of the slider 46. The coupling elements 42 and 44 are illustrated as being of the plastic filamentary coil type; however conventional slider fasteners with any other type of coupling element, such as filamentary ladder, plastic or metal molded elements, etc. can be used.

The guide 30 includes a left guide member 56 and a right guide member 58 which extend longitudinally along opposite sides of the slide fastener 32 substantially the entire length thereof. The left guide member 56 includes a center panel 60, a top flap 62 hinged at a score line 64 on the right or inner edge of the center panel 60, a bottom flap 66 hinged at a score line 68 on the left or outer edge of the center panel 60, and a reinforcing or stiffening flap 65 folded at a score line 67 to the outer or left edge of the top flap 62 and secured by adhesive 69 to an outer edge portion of the upper surface of the top flap 62; and the right guide member 56 includes a center panel 70, a top flap 72 hinged at a score line 74 on the left or inner edge of the center panel 70, a bottom flap 76 hinged at a score line 78 on the right or outer edge of the center panel 70, and a reinforcing or stiffening flap 75 folded at a score line 77 to the outer or right edge of the top flap 72 and secured by adhesive 79 to an outer edge portion of the upper surface of the top flap 72. The adhesive strips 69 and 79 are conventional paper adhesive bonding materials. The reinforcing flaps 65 and 75 are designed to render the sewing guide less flimsy and less liable to collapse. The members 56 and 58 are both secured to a bridge or center member 80, such as by strips 82 and 84 of conventional paper adhesive bonding outer edge portions of the upper surface of the center member 80 to intermediate portions of the bottom surfaces of the respective central panels 60 and 70 to form a unitary guide. Any other securing or bonding means may be used in place of the adhesive strips 69, 79, 82 and 84. The width of the center member 80 is a little less than the desired spacing between stitching lines attaching the tapes 34 and 36 to an article, and the length of the member 80 is the same as the lengths of members 56 and 58.

Folded edge portions of the panel 60 and the flap 62 adjacent the crease 64 overlie folded edge portions of the panel 70 and flap 72 adjacent the crease line 74 directly over the coupling elements 42 and 44. This overlap is selected to be sufficient to permit an edge portion of an article to be inserted on the central panel 70 underneath the flap 72 directly in alignment with the edge of an opposite edge portion of the article inserted within the member 56 over the panel 60 underneath the flap 62.

The panels 60 and 70, the member 80, and the top flaps 62 and 72 with their reinforcing flaps 65 and 75 overlie the slide fastener 32. The bottom flaps 66 and 76 are folded downward from the outer edges of the guide 30 underneath the outer edges of the tapes 34 and 36 of the slide fastener 32. Longitudinal pressure-sensitive adhesive strips 86 and 88 on the inner edge portions of the upper surfaces of the flaps 66 and 76 releasably attach the tapes 34 and 36 of the slide fastener 32 to the flaps 66 and 76. Longitudinal pressure-sensitive adhesive strips 90 and 92 are secured to outer portions of the bottom surfaces of the respective top flaps 62 and 72 while longitudinal pressure-sensitive adhesive strips 94 and 96 are mounted on the top surfaces of the respective central panels 60 and 70 spaced slightly inward from the strips 90 and 92. These strips 86, 88, 90, 92, 94 and 96 extend the full length of the guide 30.

Release coatings or strips 102 and 104 are mounted on the upper surface of the central panel 60 directly beneath the respective adhesive strips 90 and 92 to cover and protect the adhesive strips 90 and 92 while release coatings or strips 106 and 108 are similarly mounted on the bottom surface of the top flaps 62 and 72 directly over the respective adhesive strips 94 and 96 to cover and protect the adhesive strips 94 and 96 as well as permitting easy release of the top flaps 62 and 72.

A notch 110 is formed in the lower end of the guide 30 centrally between the opposite sides thereof. This notch 110 extends through the flaps 62 and 72 as well as the central panels 60 and 70 and the center panel 80. The notch 110 has an upper edge 112 and side edges 114 and 116 extending outwardly and downwardly from the ends of the edge 112 for forming a positioning notch to accurately position the guide and slide fastener relative to the bottom of an opening in a garment or other article.

A plurality of openings, perforations or windows 118 extend through the inner folded edge portions of the flaps 62 and 72 and the panels 60 and 70 as well as the center panel 80 directly over the coupling elements 42 and 44. These openings 118 are spaced longitudinally along the guide 30 along the center thereof. A larger opening 120 is located at the top end of the guide 30 centrally between the opposite sides of the guide 30 and also extends through the inner folded edge portions of the flaps 62 and 72 and panels 60 and 70 as well as the center panel 80 directly over the slider 46. The size of the openings 118 and 120 is selected to be sufficient to permit viewing of the fastener elements 42 and 44 and slider 46 as well as the edges of an article during positioning of the article edges over the fastening elements.

The member 56 has a longitudinal line of perforations 122 running through the top flap 62 and center panel 60 and running over the tape 34 along a desired line of stitching for the tape 34 while the member 58 has a longitudinal line of perforations 124 formed through the top flap 72 and center panel 70 and running over the tape 36 along a desired line of stitching for the tape 36. A bottom line of perforations 126 through the flaps 62 and 72, panels 60 and 70 and center panel 80 extends across the members 56 and 58 between the bottom ends of the lines 122 and 124 to the notch 110 below the bottom stop 48 along a desired line of bottom stitches for attaching the slide fastener to an article. Notches 128 and 130 through the flaps 62 and 72 and the panels 60 and 70 respectively, are formed in the top edges of the members 56 and 68 in line with the perforations 122 and 124 to enable easy tearing of the guide 30 along lines 122 and 124 after the slide fastener 32 is sewn to an article. The perforations 122, 124 and 126 are illustrated as being small round holes, but may have any other configuration, close together so as to leave very little material between the perforations underneath the thread forming stitches attaching the tapes 34 and 36 to an article but far enough apart to maintain substantial stiffness and stability in mounting the slide fastener in an article.

Figure 3:
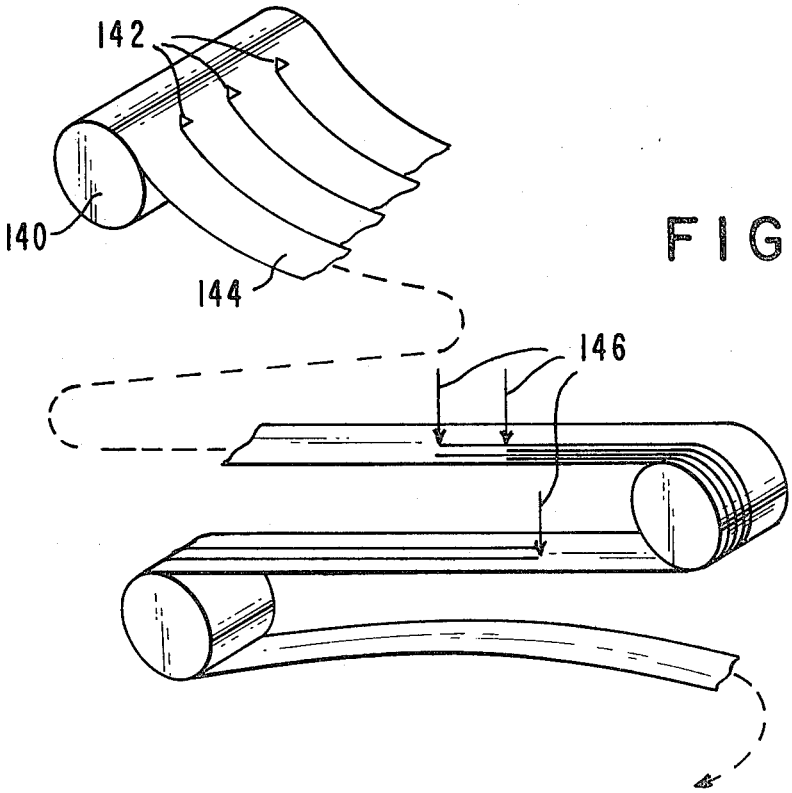
FIG. 3 is a diagram illustrating several steps in the manufacture of the article of FIGS. 1 and 2.

In the preferred embodiment of the method of manufacture of the article of FIGS. 1 and 2, large rolls of paper stock, such as roll 140 in FIG. 3, are cut at cutting stations 142 to smaller widths of stock strips 144. The paper stock material is selected for being flexible but having natural resilience against bending or folding except where score or hinge lines have been formed. Preferred paper materials range in thickness from 0.127 mm (0.005 in) to 0.21 mm (0.008 in.); one suitable material at the lower end of the preferred range of paper material is known as "ledger bond" and another suitable material at the upper end of the preferred range is 90 pound index paper. Thinner paper material may be used; however, very thin paper material tends to be too flexible and not hold the slide fastener in position. Thicker paper material may also be used; however, excessively thick materials interfere with sewing as well as being too inflexible and too costly. The paper material is suitable for forming adhesive and release coatings thereon and may be pretreated to prepare for the appropriate adhesive and release coatings. The width and number of the stock strips 144 cut from the roll 140 are determined by the size of the stock roll 140 and the desired width of strip 144 suitable for passing through commercial adhesive and coating equipment.

The stock strips 144 are passed through a coating station or stations 146 where pressure-sensitive adhesive and release material is applied in strips to the stock strip 144. This includes the application of the pressure-sensitive adhesive strips 90, 92, 94 and 96 and the release strips 102, 104, 106 and 108 to one side of the stock strip 144 and the application of the pressure-sensitive adhesive strips 86 and 88 to the opposite side of the stock strip 144. The pressure-sensitive adhesive strips are formed by conventional techniques from commercially available adhesive materials. It is preferred that the adhesive material in the strips 86 and 88 be a relatively tenacious material to avoid detachment of the slide fastener tapes 34 and 36 from the guide 30 during shipping, storing and handling. The adhesive material in the strips 90, 92, 94 and 96 is preferably selected to have relatively less tenacity to avoid damage to delicate garment materials, such as velvet, to which the strips may be releaseably attached in the attachment of the slide fastener to a garment. The release coatings or strips 102, 104, 106 and 108 are preferably commercial silicone release materials applied by conventional techniques.

Figure 4:
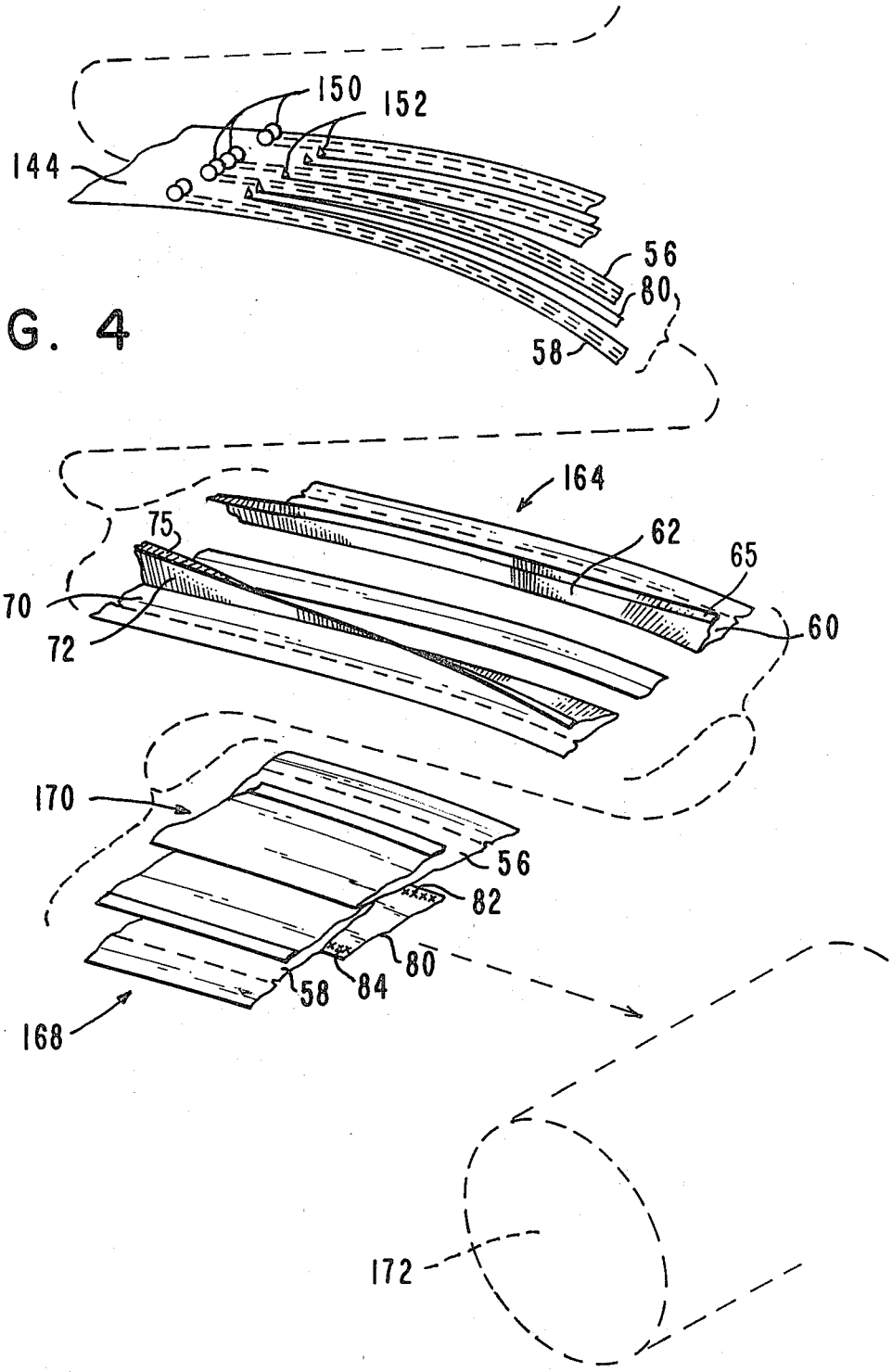
FIG. 4 is a diagram illustrating several steps subsequent to the steps of FIG. 3.

After the coating, the stock strip 144 passes through a scoring station or stations 150, illustrated in FIG. 4, and cutting station or stations 152. The scoring stations 150 form the scoring lines 64, 67, 68, 74, 77 and 78. The cutting stations 152 divide the stock strip 144 into one or more groups of assembly strips, each group including the left member strip 56, and the right member strip 58.

The center member strip 80 can also be cut from the stock strip 144, as illustrated in FIG. 4, or can be provided from a separate stock source.

Each group of assembly strips 56, 58 and 80 pass through a folding station indicated generally at 164 where the reinforcing flap strips 65 and 75 are folded and secured to the top flap strips 62 and 72 by suitable means such as adhesive 69 and 79 (FIG. 2), and the top flap strips 62 and 72 are folded over the center panel strips 60 and 70, respectively. It is noted that at this time the adhesive strips 90, 92, 94 and 96 will be lightly adhered to the release strips 102, 104, 106 and 108. The folded strips 56 and 58 of FIG. 4 can be considered as continuous member sections corresponding to pluralities of the members 56 and 58 of FIGS. 1 and 2 and joined together in a pair of strips, and the center strip 80 of FIG. 4 can be considered as continuous center strip sections corresponding to a plurality of the center members 80 of FIGS. 1 and 2 and joined together in a strip.

After folding, the assembly strips pass to an assembly station indicated generally at 168, where the left and right members 56 and 58 are superimposed over the member 80 with the inner folded edges of the strip portions 56 and 58 overlapping. The strip members 56 and 58 are then attached to the center member 80, for example by adhesive strips 82 and 84, or any other bonding or attaching procedure. The attachment of the member strips 56 and 58 to the center member strip 80 is a permanent attachment to form joined composite sections or a composite strip, indicated generally at 170, which may then be reeled as shown at 172.

The composite strip 170 is then dereeled and presented to a cutting and punching station indicated generally at 176 in FIG. 5 where the composite strip 170 is cut at 178 to a length slightly less than the length of the slide fastener. Also at the punching station 176 the lines of perforations 122, 124 and 126 are punched through the composite strip and the notches 110, 128 and 130 and the window openings or perforations 118 and 120 are also punched through the composite strip to complete the formation of guide sections 30. The guide sections 30 can then be stacked.

The guide sections 30 are assembled on the slide fasteners 32 at an assembly station 182 while the slide fasteners are joined in a continuous chain by the tapes 34 and 36 extending continuously through the length of the chain. The guide section 30 is attached to a section of the continuous slide fastener chain corresponding to a slide fastener 32 by positioning the guide section 30 over the section of slide fastener chain and folding the flaps 66 and 76 around outer edges of the tapes 34 and 36 as shown in FIG. 6 to attach the adhesive strips 86 and 88 to the undersides of the tapes 34 and 36. Subsequently the slide fastener chain is cut between successively attached guide sections 30 at a cutting station 184 to complete the manufacture of the article shown in FIGS. 1 and 2. Alternatively, the cutting station 184 may be positioned prior to the assembly station 182 and the guides 30 assembled on the slide fastener 32 after they have been cut from the continuous chain. In another alternative, punching station 176 does not form the cuts 178 between guide sections 30 prior to the assembly station 182; the cuts 178 are performed at station 184 after the joined guide sections 30 are assembled on the slide fastener sections 32 which may be joined or may be previously separated.

In a modified process, a single member strip is cut and folded instead of the cutting and folding of the two member strips 56 and 58 of FIG. 4. This single strip is severed into sections with alternate sections being turned and paired with non-turned sections. The paired sections are then assembled on sections of the center strip 80 which can be a continuous strip or can be separate severed sections to form composite sections.

The present method results in a slide fastener carried by a guide with a minimum amount of increase in cost above the cost of the slide fastener by itself.

As an alternative to the use of rolls of paper stock and continuous stock strips, sheets of paper may be used; there being appropriate modifications made in the cutting and the adhesive and release coating steps to accomodate the sheet material rather than a continuous strip stock. Non-continuous procedures of coating, slitting, etc. and alternate adhesive means may be substituted.

Since many variations, modifications and changes in detail may be made to the embodiment described above, it is intended that all matter in the foregoing description and shown in the accompanying drawings be interpreted as illustrative and not in a limiting sense.

What is claimed is:

1. A method of forming slide fasteners with attached sewing guides comprising coating a stock strip of paper with strips of adhesive and release material, the adhesive strips being suitable for adhering to tapes of a slide fastener and to an article to which the slide fastener is to be sewn, forming pairs of member sections with folded article-holding flaps from the stock strip, attaching the pairs of member sections to center strip sections to form composite sections, punching perforations in the composite sections to form guide sections, and attaching the guide sections by means of at least two of the strips of adhesive to tapes of a slide fastener.

2. A method as claimed in claim 1 wherein the punching includes punching perforated lines in the composite sections to form sewing guide lines.

3. A method as claimed in claim 1 wherein the forming includes cutting left and right member strips from the stock strip, folding the left and right member strips to form the folded article-holding flaps, the pairs of member sections being corresponding sections of the left and right member strips, and the attaching forms a composite strip of the composite sections.

4. A method as defined in claim 1 wherein the forming includes cutting a member strip from the stock strip, folding the member strip to form an article-holding flap, and severing the member strip into the pairs of member sections.

5. A method as claimed in claim 3 wherein the composite strip is severed into lengths corresponding to lengths of individual slide fasteners prior to the attaching of the guide sections to the slide fastener tapes, and the attaching of the guide sections to the slide fastener tapes includes attaching the severed lengths of the composite strip to tapes of slide fasteners.

6. A method as claimed in claim 5 wherein the attaching of the severed lengths of the composite strip to tapes of slide fasteners is performed while the slide fasteners are joined in a continuous slide fastener chain, and wherein there is included the step of severing the continuous slide fastener chain between the attached lengths of composite strip to form slide fasteners with attached sewing guides.

7. A method as claimed in claim 6 including the step of cutting the stock strip of paper from a large roll of stock, and the cutting of the left and right member strips from the stock strip includes cutting the stock strip into a plurality of groups of assembly strips, each including left and right member strips.

8. A method as claimed in claim 3, 5, 6 or 7 wherein the cutting of the left and right member strips from the stock strip includes cutting a center strip from the stock strip, the center strip including the center strip sections.

9. A method as claimed in claim 1, 2, or 3 wherein the punching includes punching window openings in the composite strip for exposing fastening elements of a slide fastener through the article-holding flaps of the guide.

10. A method as claimed in claim 1, 2, or 3 wherein the punching includes punching notches in the leading edges of the perforated lines to enable easy tearing of a guide after installation of a slide fastener.

11. A method as claimed in claim 1, 2, or 3 wherein the punching includes punching a notch in the trailing end of a composite strip to form a guide for positioning a slide fastener relative to an end of a garment opening.

12. A method as claimed in claim 1, 2, 3, 4, 5, 6, or 7 wherein the attaching of the composite sections to the tapes of a slide fastener include folding flaps of the guide sections around outer edges of the tapes and adhering the at least two of the strips of adhesive to undersides of the tapes.

13. A method as claimed in claim 1 wherein the folding includes folding and securing reinforcing flaps to upper outer edge portions of the article-holding flaps.

14. A method as claimed in claim 1, 2, 3, 4, 5, 6 or 7 wherein the coating includes coating the stock strip with at least four adhesive strips including the at least two adhesive strips by means of which the guide sections are attached to the slide fastener, and two additional adhesive strips suitable for adhering to the article to which the slide fastener is to be sewn.

* * * * *